United States Patent [19]

Weiler et al.

[11] 4,056,129

[45] Nov. 1, 1977

[54] CLOSABLE STERILE CONTAINER

[75] Inventors: Herbert Weiler; Hans Schneider, both of Marburg an der Lahn; Ludwin Weyrich, Buchenau, all of Germany

[73] Assignee: Behringwerke Aktiengesellschaft, Marburg an der Lahn, Germany

[21] Appl. No.: 751,162

[22] Filed: Dec. 16, 1976

[30] Foreign Application Priority Data

Dec. 20, 1975 Germany ..... 7540657[U]

[51] Int. Cl.[2] ..... B65B 3/04

[52] U.S. Cl. ..... 141/24; 215/253; 222/541

[58] Field of Search ..... 141/22, 23, 24; 222/541, 207, 420; 215/250, 252, 253

[56] References Cited

U.S. PATENT DOCUMENTS

| | | | |
|---|---|---|---|
| 2,742,195 | 4/1956 | Elder, Jr. | 141/24 |
| 3,072,277 | 1/1963 | Hoffmann | 215/253 |
| 3,459,315 | 8/1969 | Labarre | 215/253 |

*Primary Examiner*—Stanley H. Tollberg
*Assistant Examiner*—Hadd S. Lane
*Attorney, Agent, or Firm*—Curtis, Morris & Safford

[57] ABSTRACT

The subject matter of the invention is a closable sterile container and the associated closure cap, which can simultaneously be used as a pipette and which is a tamper-proof closure in conjunction with the container.

2 Claims, 2 Drawing Figures

CLOSABLE STERILE CONTAINER

The subject matter of the invention is a closable sterile container, which is suitable for the storage in particular of medicaments and reagents in liquid form, the associated closure cap, which can simultaneously be used as a pipette and which is a tamper-proof closure in conjunction with the container.

Preparations which are to be stored under septic conditions, removed by a pipette and safeguarded by means of a tamper-proof closure, have hitherto been filled into containers with a threaded closure. The closure used was a flanged cap, preferably made of aluminum, in which a pipette suction means made of rubber or plastics had been mounted. The pipette suction means was in turn provided with a pipette of glass or plastics material.

The mounting and flanging on of this cap was effected under sterile conditions on a rolling machine. The pre-mounting of the pipette suction means and pipettes in the flanged cap as well as mounting and closing—both steps done largely by hand—are time-consuming and involve the risk of contamination.

The subject matter of the invention is a closable sterile container with associated closure cap, in which the closure cap is characterised in that the sealing face is extended in the form of a pipette and a pipette suction means is arranged on the cover plate. This invention has the advantage that a further closure element like the mentioned flanged cap is not necessary since the closure consists of one member. After filling the container the closure cap can be placed and pressed onto the container by machine. The subsequent transport of the container to the flanging machine and the mounting and flanging of the flanged cap can be dispensed with. A subsequent germ infiltration, which can occur on the transport path to the rolling machine or during the rolling process, is precluded by the arrangement according to the invention. Simultaneously the invention permits an original closure to be produced in one operating step. Although the new closure is an original closure, it can be opened without the risk of hurting the hands and more easily than the known arrangements according to the State of the Art.

Figure 1:
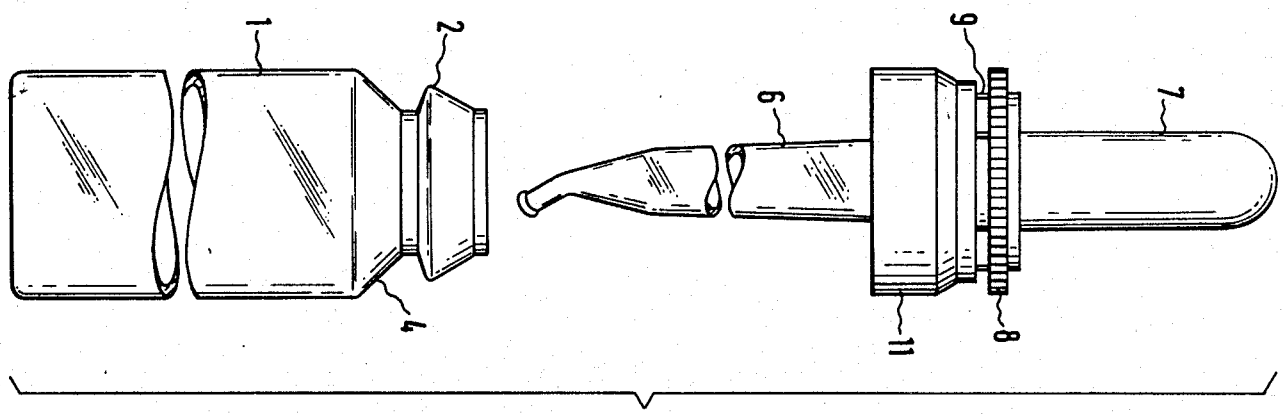
Figure 2:
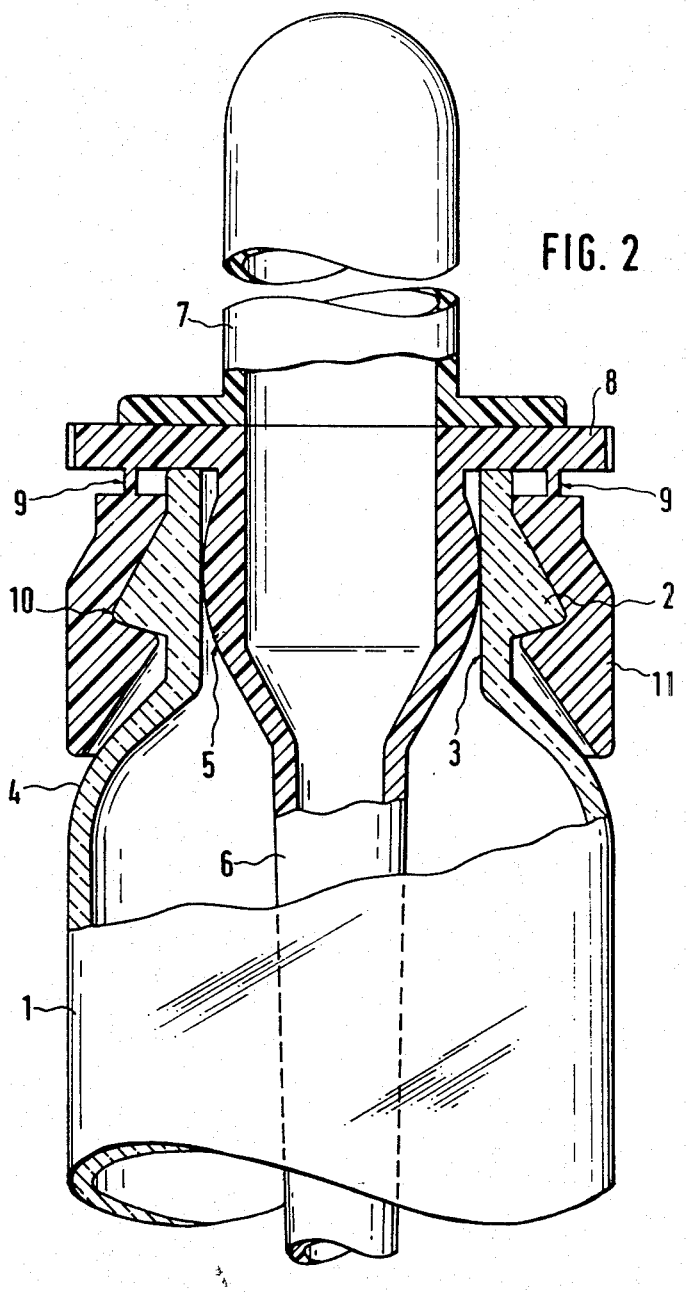

The design of the bottle and cap can be seen in the accompanying diagrams. In the diagram, FIG. 1 shows a view of the container and of the closure cap, FIG. 2 shows a section through the container with the closure cap mounted.

In the diagram

1. represents the container body
2. the double cone ring
3. the sealing face of the container
4. the shoulder of the container
5. the sealing face of the closure
6. represents the pipette
7. the pipette suction means
8. the head plate
9. tear-off bars
10. the surrounding groove
11. lower ring of the closure cap The double-cone ring 2 of the container has an upper incline of 50°–65°, preferably 60°, and a lower incline of 10°–18°, preferably 15°. The internal diameter of the cylindrical portion of the container neck 3 depends on the external diameter of the sealing face of the closure 5 and is so designed that a seal is guaranteed between cap and container. The wall thickness of the glass resulting from the internal and external diameter of the container must be of such strength that it withstands the stresses occurring during closure.

The use of the container according to the invention for the sterile storage of pharmaceutical preparations is as follows:

First of all the product, for example a liquid which is to be stored under sterile conditions, is introduced into the container. Subsequently, on the same machine, the cap is placed on the container and pushed into the container. When the cap is pressed in, as a result of the upper cone of the double-cone ring of the container head 2, the lower ring 11 of the closure cap expands in accordance with the elasticity of the cap material as the pressing-in operation progresses until the groove 10 of the cap ring locks onto the double-cone ring 2 in the cylindrical portion of the container neck. Since the container body is greater than the container neck, the container shoulder 4 is provided with radii suited to the flow of force, which cause the forces occurring on closure to be dispersed into the container wall. The container is therefore prevented from bursting in the shoulder region. While the cap is being pressed in, the sealing face 5 of the closure is placed against the sealing face 3 of the container and in this manner a tight seal is formed.

A special advantage of the arrangement according to the invention is to be seen in that it represents an original closure or a tamper-proof closure. The closure cannot be opened without damaging the bars.

To open the container, the cap is lifted by thumb pressure against the plate 8, as a result of which the bars 9 break. The lower ring of the closure cap remains on the container. After the bars 9 of the container cap have been destroyed, the remaining portion of the cap, i.e. the head plate 8 with associated pipette 6 and pipette suction means 7, can be removed from the container. This above-described remaining portion is a pipette with which the preparation can be removed from the container and pipetted.

The container can, after use, be closed again with the pipette by pressing the pipette back into the container. The closure is carried out as before by the sealing face 5 of the closure and the sealing face 3 of the container.

The material used for the container is preferably glass, and that used for the cap is preferably polyethylene, polypropylene or similar plastics materials.

We claim:

1. Closable sterile container with associated closure cap, characterised in that the closure cap consists of a head plate 8 with pipette 6 and pipette suction means 7, wherein the pipette wall is designed as a sealing face, and of a connected hollow-cylindrical ring 11, the perpendicular wall of which has on the inside a surrounding groove 10 and extends from the latter conically outwards, and that both parts of the closure cap are joined together by tear-off bars 9.

2. Closable sterile container according to claim 1, characterised by a double-cone ring at the container head, which effects a tamper-proof closure with the cap, and by the design of the container shoulder suited to the flow of forces.

* * * * *